US005997341A

United States Patent [19]

Ushiyama et al.

[11] Patent Number: 5,997,341

[45] Date of Patent: Dec. 7, 1999

[54] TERMINAL CONNECTING-FIXING CONSTRUCTION

[75] Inventors: Keiji Ushiyama; Toshirou Mochizuki, both of Shizuoka, Japan

[73] Assignee: Yazaki Corporation, Tokyo, Japan

[21] Appl. No.: 09/113,374

[22] Filed: Jul. 10, 1998

[30] Foreign Application Priority Data

Oct. 7, 1997 [JP] Japan ..... 9-185134

[51] Int. Cl.[6] ..... H01R 13/00

[52] U.S. Cl. ..... 439/480; 439/801

[58] Field of Search ..... 439/801, 476.1, 439/480, 483

[56] References Cited

FOREIGN PATENT DOCUMENTS 2252877 8/1992 United Kingdom ..... 439/476.1

*Primary Examiner*—Gary Paumen

*Attorney, Agent, or Firm*—Morgan, Lewis & Bockius LLP

[57] ABSTRACT

A terminal connecting-fixing construction for fixedly fastening at least two plate-like terminals to a mating connection portion having connection bolts corresponding respectively to the terminals, each of the terminals including a wire connection portion formed integrally with and extending from an electrical contact portion having a screw insertion hole, the terminal connecting-fixing construction comprises: a terminal retaining piece portion for positioning the terminal, formed on that edge of the electrical contact portion directed away from the wire connection portion; and a positioning member which includes positioning terminals for fitting respectively on the terminal retaining piece portions, and a mounting board fixedly holding the positioning terminals such that the positioning terminals correspond respectively to the connection bolts, wherein the terminals are fixedly fastened, together with the positioning member, to the mating connection portion.

8 Claims, 8 Drawing Sheets

TERMINAL CONNECTING-FIXING CONSTRUCTION

BACKGROUND OF INVENTION

This invention relates to a terminal connecting-fixing construction for fixedly fastening plate-like terminals (used in an automobile) to a mating connection portion having connection bolts.

FIG. 8 shows a terminal 1 to be fixedly connected to a connection portion in a vehicle, the terminal having a wire clamped thereto. This terminal 1 includes a wire connection portion 3 formed integrally with and extending from an electrical contact portion 2 of an annular disk-shape. A screw insertion hole 4 is formed through a central portion of the electrical contact portion 2, and the wire connection portion 3 for holding the wire 5 has a conductor clamping portion 6 and an insulating sheath clamping portion 7, and the two clamping portions 6 and 7 are forcibly deformed to clamp the wire 5.

A terminal 8, shown in FIG. 9, has a plurality of upwardly-directed guide pawls 9 formed integrally with and extending from an peripheral edge of an electrical contact portion 2', and free end portions of these guide pawls are bent into parallel relation to the electrical contact portion 2', so that a nut member 10 is angularly movably mounted on the electrical contact portion 2'. The nut member 10 includes a nut 10*b* provided on an upper end of a body shank portion 10*a*, and a flange-like guide portion 10*c* (for the guide pawls 9) formed at a lower end of the body shank portion 10*a*.

The terminals 1, 8 are mounted, for example, on a mating connection portion 11 of a vehicle as shown in FIG. 10 (In this Figure, explanation will be made with respect to the nut-carrying terminals 8). The connection portion 11 has two closely-spaced terminal connection bolts 12 and 12 formed upright on an upper surface of a body portion 13, and a pair of terminals 8 and 8 are fitted respectively on the two bolts 12 and 12 through their respective screw insertion holes 4 in a direction of arrow P, and are positioned in parallel relation to each other, and then each terminal 8 is fixedly fastened by the nut member 10 (see FIG. 11).

In the above conventional techniques, if the nuts are not fully tightened when mounting the terminals 1 or 8 on the connection portion 11, or if the nuts become loose by vibrations or others during the running of the vehicle, there is a possibility that the terminals 8 are angularly moved as shown in FIG. 12, so that the wire connection portions 3 contact each other, thus causing a condition undesirable from the viewpoint of the electrical connection.

And besides, the bolts 12 and 12 are provided in proximity to each other, and therefore it has been very difficult to position the terminals 1 or 8 in parallel relation to each other, and then to mount these terminals on the connection portion, and therefore much skill has been required for this operation.

SUMMARY OF INVENTION

The present invention has been made in order to solve the above problems, and an object of the invention is to provide a terminal connecting-fixing construction in which terminals are always kept positioned relative to a mating connection portion in a good condition, and the efficiency of a terminal-mounting operation is enhanced.

The above object has been achieved by the invention of claim 1 which provides a terminal connecting-fixing construction for fixedly fastening at least two plate-like terminals to a mating connection portion having connection bolts corresponding respectively to the terminals; each of the terminals including a wire connection portion formed integrally with and extending from an electrical contact portion having a screw insertion hole, the terminal connecting-fixing construction comprising: a terminal retaining piece portion for positioning the terminal is formed on that edge of the electrical contact portion directed away from the wire connection portion; and a positioning member which includes positioning terminals for fitting respectively on the terminal retaining piece portions, and a mounting board fixedly holding the positioning terminals in such a manner that the positioning terminals correspond respectively to the connection bolts, wherein the terminals are fixedly fastened, together with the positioning member, to the mating connection portion.

Preferably, each of the positioning terminals includes an electric conductor portion for the electrical contact portion of the terminal, a positioning portion for fitting on the terminal retaining piece portion to prevent the angular movement and withdrawal of the terminal, and a fixing portion fixedly mounted on the mounting board, and the electric conductor portion, the positioning portion and the fixing portion are formed integrally with one another, and the electric conductor portion has a screw hole corresponding to the screw insertion hole in the electrical contact portion, and the positioning portion includes a pair of angular movement prevention guide grooves for guiding the terminal retaining piece portion, and a retaining pawl for preventing the terminal retaining piece portion from moving in a withdrawing direction.

Preferably, the terminal retaining piece portion has a pair of opposed side portions, and a lock hole for engagement with the retaining pawl.

Preferably, the lock hole has such a large size that the terminal retaining piece portion is formed into a U-shaped frame-like configuration.

Preferably, a width of the terminal retaining piece portion between outer edges of the opposed side portions is smaller than a width of the electrical contact portion between opposite side edges thereof extending in a direction of an axis of the terminal, so that stoppers for engagement with the angular movement prevention grooves are formed at the junction between the terminal retaining piece portion and the electrical contact portion.

Preferably, the terminal has a plurality of guide pawls formed on a peripheral edge of the electrical contact portion, and a nut member angularly movably mounted on the electrical contact portion by the guide pawls.

DETAILED DESCRIPTION OF PREFERRED EMBODIMENTS

Figure 1:
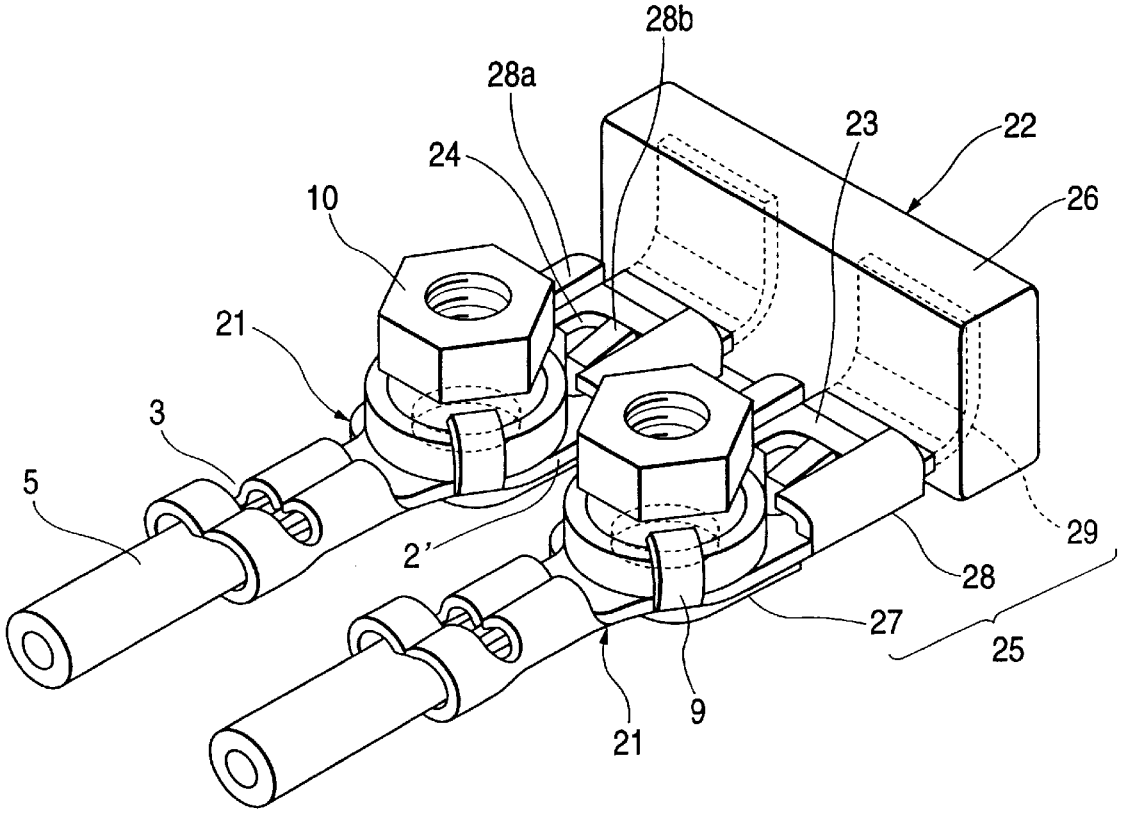
FIG. 1 is a perspective view showing the appearance of one preferred embodiment of a terminal connecting-fixing construction of the prevent invention.
Figure 2:
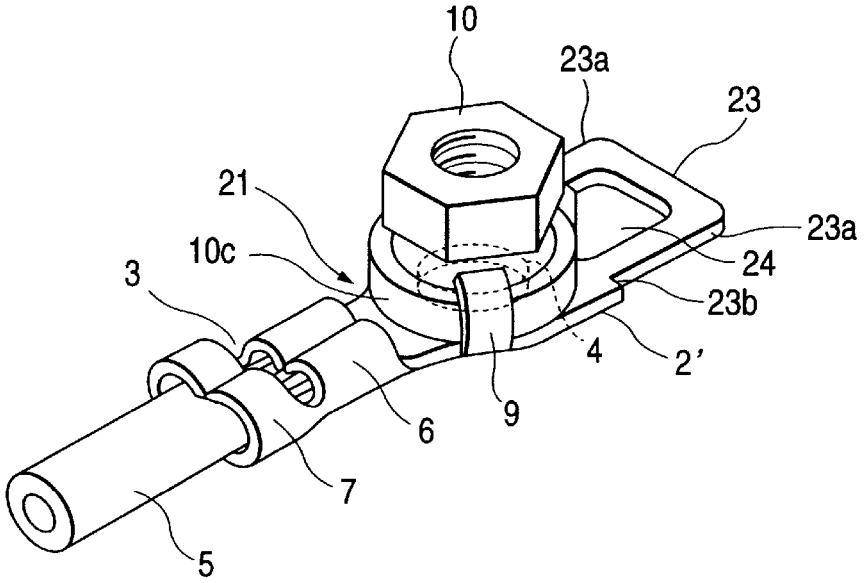
FIG. 2 is perspective view showing the appearance of a nut-carrying terminal in FIG. 1.
Figure 3:
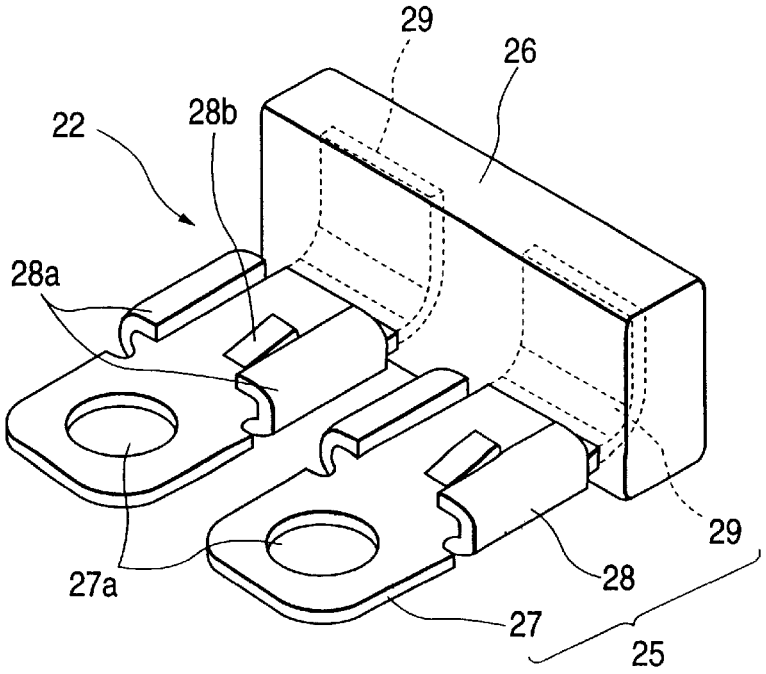
FIG. 3 is a perspective view showing the appearance of a positioning member in FIG. 1.

One preferred embodiment of the present invention will now be described with reference to the drawings. FIG. 1 is a perspective view showing the appearance of one preferred embodiment of a terminal connecting-fixing construction of the invention, FIG. 2 is perspective view showing the appearance of a nut-carrying terminal in FIG. 1, and FIG. 3 is a perspective view showing the appearance of a positioning member in FIG. 1. Those portions of this embodiment identical to those of the conventional constructions will be designated by identical reference numerals, respectively, and explanation thereof will be omitted.

In FIG. 1, a pair of plate-like, nut-carrying terminals 21 for an automobile are fitted in the positioning member 22 by which the terminals 21 are set in accordance with mounting positions on a mating connection portion, and the terminals 21, together with the positioning member 22, are fixedly secured by screws to the mating connection portion.

The terminal 21 is formed by pressing an electrically-conductive metal sheet made of copper or a copper alloy (e.g. beryllium-copper or brass), and as shown in FIG. 2, the terminal 21 includes a wire connection portion 3 formed integrally with and extending from an electrical contact portion 2' having a screw insertion hole 4, and a wire 5 is clamped by a conductor clamping portion 6 and an insulating sheath clamping portion 7, and is connected to the wire connection portion 3. A plurality of upwardly-directed, guide pawls 9 are formed integrally with and extend from an peripheral edge of the electrical contact portion 2', and free end portions of these guide pawls 9 are inwardly bent into parallel relation to the electrical contact portion 2', and guide a guide portion 10*c* of a nut member 10, so that the nut member 10 is angularly movably mounted on the electrical contact portion 2'.

The electrical contact portion 2' has a terminal retaining piece portion 23 extending from that edge thereof, directed away from the wire connection portion 3, in a direction of an axis of the terminal 21, the terminal retaining piece portion 23 having a pair of opposed side portions 23*a* and 23*a*. The terminal retaining piece portion 23 has a large central opening serving as a lock hole 24, and is formed into a U-shaped frame-like configuration. The width of the terminal retaining piece portion 23 between the outer edges of the two side portions 23*a* is smaller than the width of the electrical contact portion 2' between the opposite side edges thereof extending in the direction of the axis of the terminal, so that step portions 23*b*, serving as stoppers, are formed between the terminal retaining piece portion 23 and the electrical contact portion 2'.

The positioning member 22, shown in FIG. 3, comprises a pair of positioning terminals 25 and 25 each for the electrical contact portion 2' and terminal retaining piece portion 23 of the associated terminal 21, and a mounting board 26 of a synthetic resin which fixes the positioning terminals 25 and 25 in a juxtaposed manner at a pitch corresponding to the pitch of the mounting positions on the mating mounting portion (described later). Like the terminal 21, the positioning terminal 25 is formed by pressing an electrically-conductive metal sheet made of copper or a copper alloy (e.g. beryllium-copper or brass). The mounting board 26 is made, for example, of a thermoplastic resin such as nylon 66 (tradename) and PP (polypropylene), and is formed into a rectangular parallelepiped shape by injection molding or the like.

The positioning terminal 25 includes an electric conductor portion 27 for the electrical contact portion 2', and a positioning portion 28 for fitting on the terminal retaining piece portion 23 to prevent the angular movement and withdrawal of the terminal 21 is formed integrally with the electric conductor portion 27. A fixing portion 29 of a rectangular shape, which is bent into an L-shape, and is insert molded in the mounting board 26, is formed on the positioning portion 28.

A screw hole 27*a* is formed through that portion of the electric conductor portion 27 corresponding to the screw insertion hole 4 in the electrical contact portion 2'. Opposite side edge portions of the positioning portion 28 are bent to respectively form a pair of angular movement prevention guide grooves 28*a* and 28*a* for respectively guiding the side portions 23*a* and 23*a* of the terminal retaining piece portion 23. A retaining pawl 28*b* for engagement in the lock hole 24 is formed on a central portion of the positioning portion 28 such that the retaining pawl 28*b* has a wedge shape gradually higher toward the positioning member 22.

Figure 4:
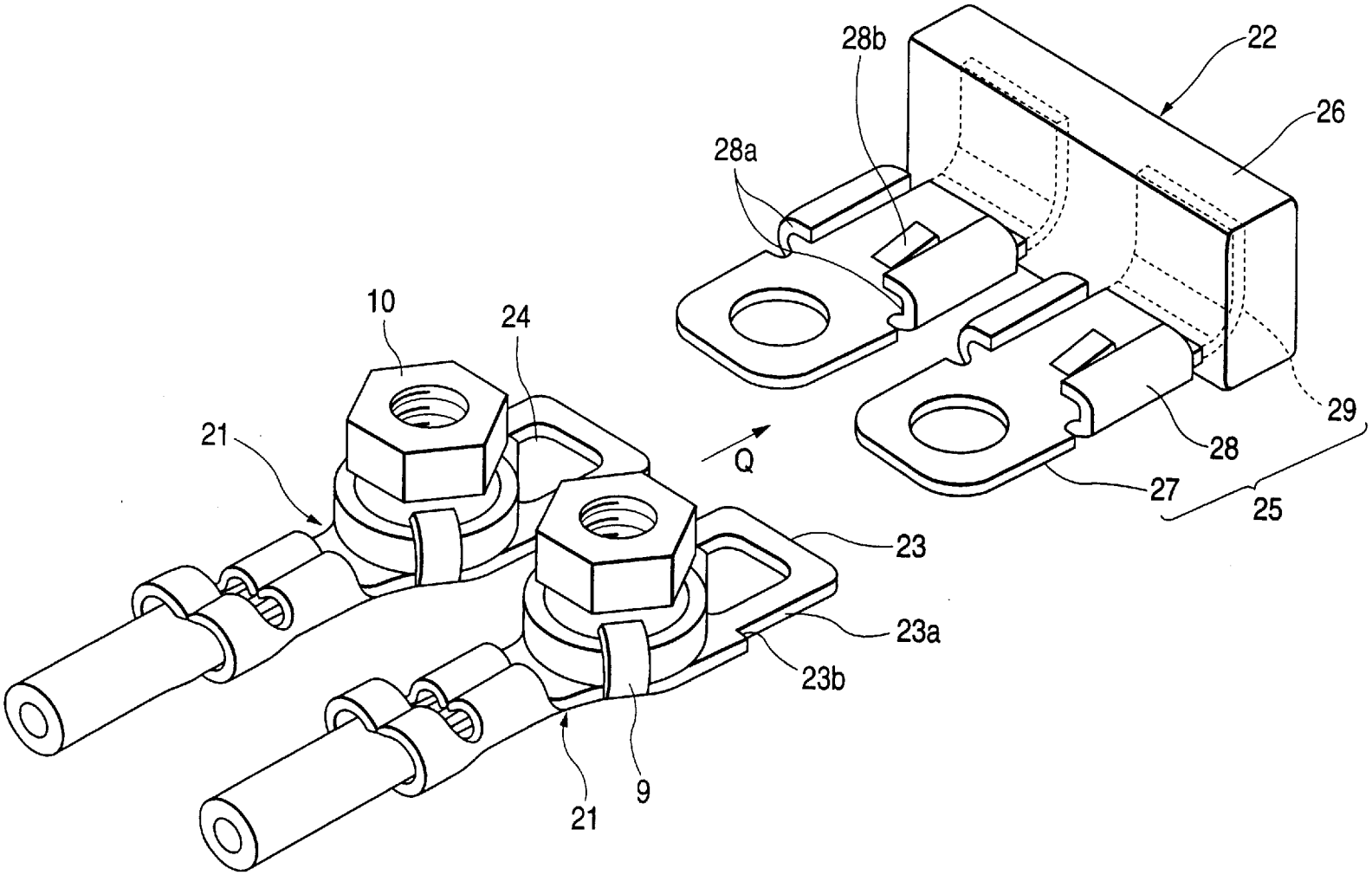
FIG. 4 is a perspective view showing the process of fitting a pair of terminals into the positioning member.

In the above construction, the process of fitting the pair of terminals 21 and 21 into the positioning member 22 will be described with reference to FIG. 4. When each terminal 21 is moved in a direction of arrow Q, with the terminal retaining piece portion 23 directed toward the positioning terminal 25, and is attached to the associated positioning terminal 25, the side portions 23*a* and 23*a* of the terminal retaining piece portion 23 are guided respectively by the angular movement prevention guide grooves 28*a* and 28*a*, and then when the terminal retaining piece portion 23 is further inserted until the step portions 23*b* and 23*b* of the terminal 21 abut respectively against the angular movement prevention guide groove portions 28*a* and 28*a*, the terminal retaining piece portion 23 is slightly flexed to slide over the retaining pawl 28*b*, and the retaining pawl 28*b* is engaged in the locking hole 24. As a result, the terminals 21 and 21 are fixedly connected to the positioning member 22 in such a manner that the terminals 21 and 21 are held in parallel, juxtaposed relation to each other at a pitch corresponding to the pitch of the mounting positions on the mating connection portion, as shown in FIG. 1.

Figure 5:
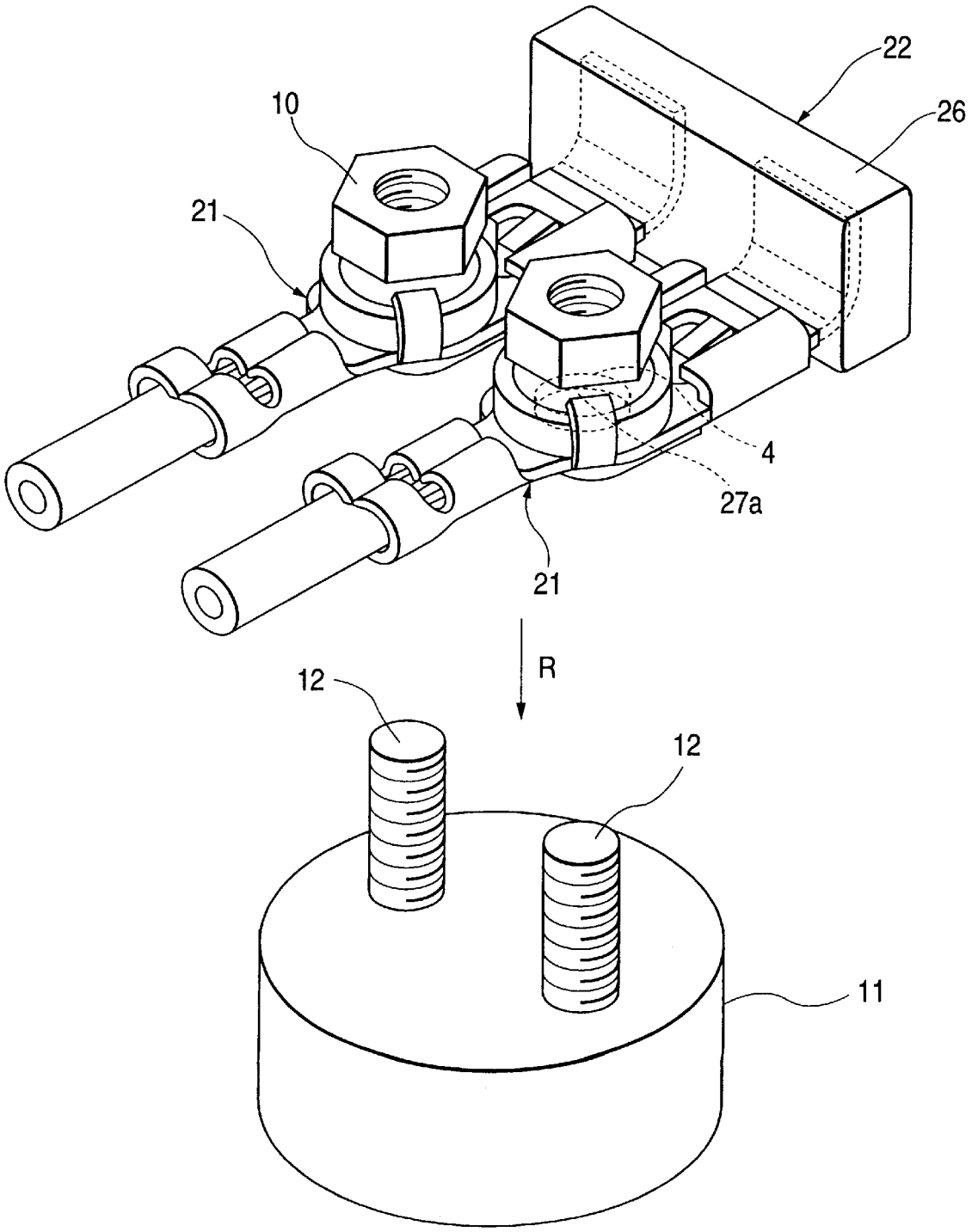
FIG. 5 is a perspective view showing the manner of mounting the pair of terminals, together with the positioning member, on a mating connection portion.

As shown in FIG. 5, the pair of terminals 21 and 21, together with the positioning member 22, are connected to the mating connection portion 11. As in the conventional construction, the connection portion 11 has a pair of closely-spaced bolts 12 and 12 constituting positive and negative electrodes, respectively. Each bolt 12 is passed through the screw hole 27*a* (see FIG. 3) in the positioning member 22 and the screw insertion hole 4 (see FIG. 2), and the nut member 10 is threaded on the bolt 12, thereby fixedly fastening each of the terminals 21 and 21 to the connection portion 11 (see FIGS. 6 and 7). The positioning member 22 is fastened to the terminals 21 and 21.

Figure 6:
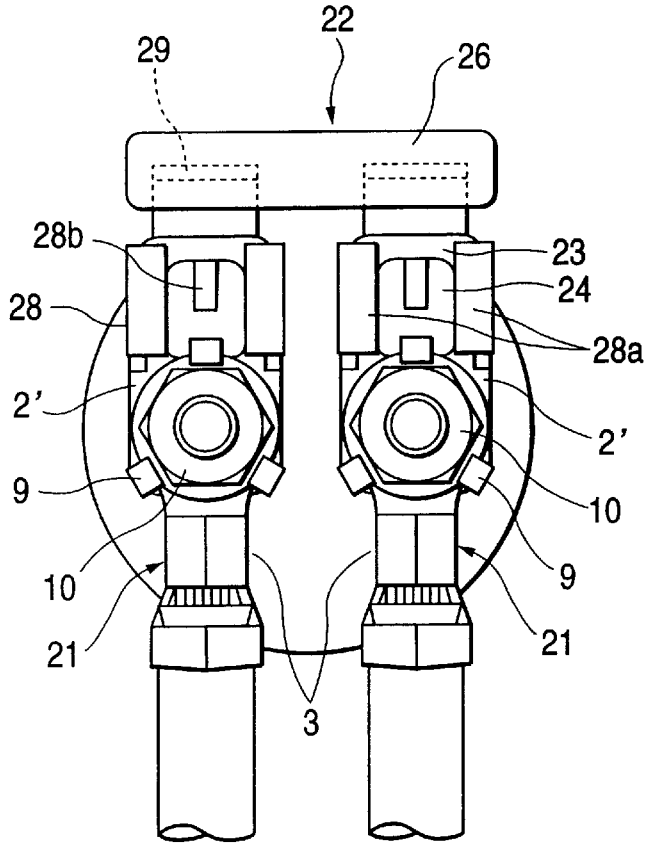
FIG. 6 is a front-elevational view showing a condition in which the terminals are fixedly secured to the mating connection portion.
Figure 7:
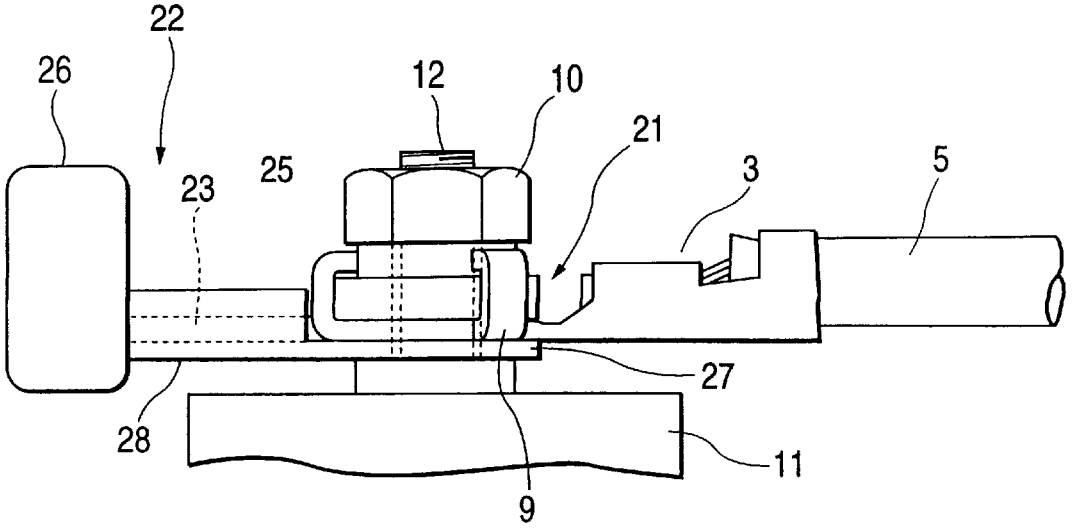
FIG. 7 is a side-elevational view showing a condition in which the terminals are fixedly secured to the mating connection portion.
Figure 8:
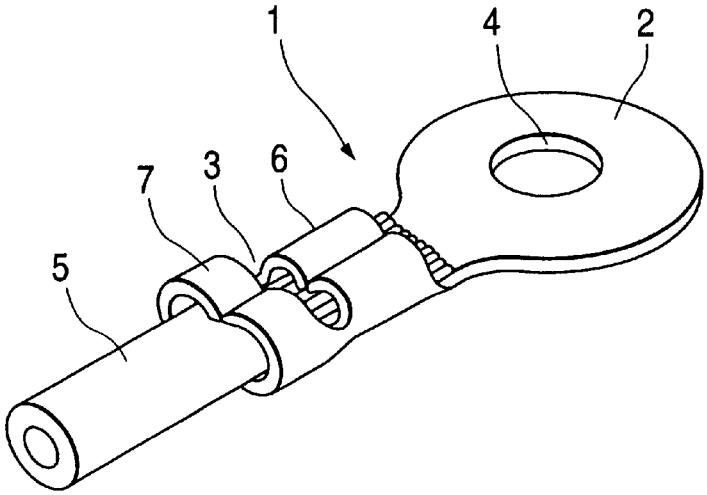
FIG. 8 is a perspective view showing the appearance of a conventional plate-like terminal of an annular shape.
Figure 9:
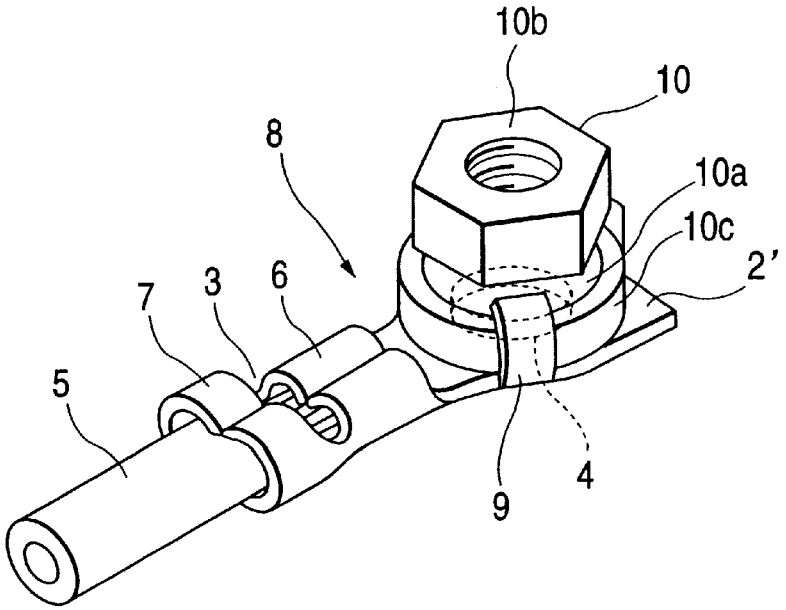
FIG. 9 is a perspective view showing the appearance of a conventional nut-carrying terminal.
Figure 10:
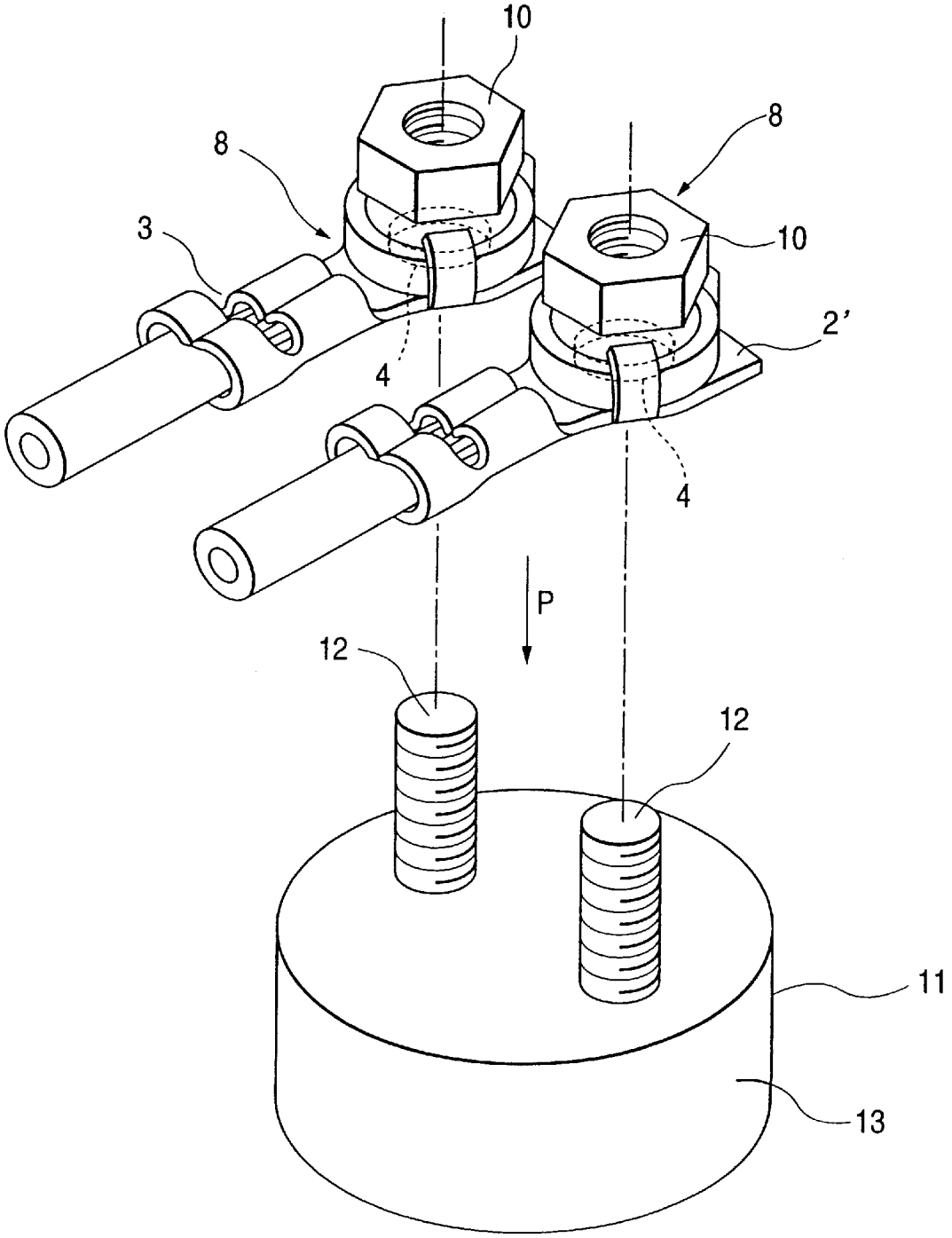
FIG. 10 PRIOR ART
FIG. 10 is a perspective view showing the manner of mounting the terminals of FIG. 9 on a mating connection portion.
Figure 11:
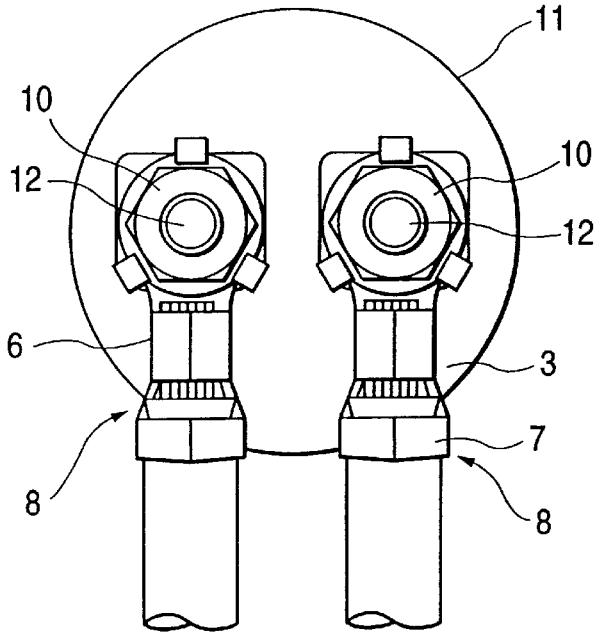
FIG. 11 PRIOR ART
FIG. 11 is a front-elevational view showing a condition in which the terminals of FIG. 9 are fixedly secured to the mating connection portion.
Figure 12:
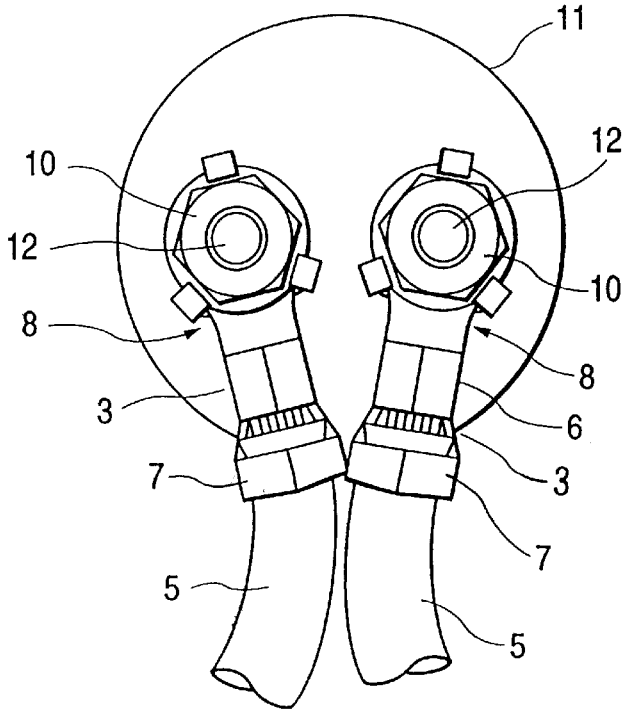
FIG. 12 PRIOR ART
FIG. 12 is a view showing a condition in which the terminals of FIG. 11 are in contact with each other.

The positioning terminals 25 are mounted on the mounting board 26 at the pitch corresponding to the pitch of the bolts on the mating connection portion 11, and therefore the positioning of the terminals 21 can be effected easily, and the efficiency of the terminal-mounting operation is markedly enhanced. The terminals 21 are held against angular movement, insertion and withdrawal, and are always kept fixedly connected to the connection portion 11 as shown in FIGS. 6 and 7, and therefore there would not occur any condition undesirable from the viewpoint of the electrical connection. The terminal 21 is not limited to the nut-carrying terminal, but the terminal retaining piece portion 23 may be formed on the conventional terminal 1 shown in FIG. 8.

In the invention described above, the terminal retaining piece portion for positioning the terminal is formed on that edge of the electrical contact portion directed away from the wire connection portion. The terminals are fitted in the positioning member which includes the positioning terminals for fitting respectively on the terminal retaining piece portions, and the mounting board fixedly holding the positioning terminals in such a manner that the positioning terminals correspond respectively to the connection bolts of the mating connection portion, and the terminals are fixedly fastened, together with the positioning member, to the mating connection portion. With this construction, there is achieved an effect that the positioning of the terminals relative to the mating connection portion is effected easily, and the efficiency of the terminal-mounting operation is markedly enhanced. There is also achieved an effect that the terminals can be positioned on the connection portion in a good condition, which prevents the development of a condition undesirable from the viewpoint of the electrical connection.

Moreover, each of the positioning terminals includes the electric conductor portion for the electrical contact portion of the terminal, the positioning portion for fitting on the terminal retaining piece portion to prevent the angular movement and withdrawal of the terminal, and the fixing portion fixedly mounted on the mounting board, and the electric conductor portion, the positioning portion and the fixing portion are formed integrally with one another. The electric conductor portion has the screw hole corresponding to the screw insertion hole in the electrical contact portion, and the positioning portion includes the pair of angular movement prevention guide grooves for guiding the terminal retaining piece portion, and the retaining pawl for preventing the terminal retaining piece portion from moving in the withdrawing direction. With this construction, there is achieved an effect that the angular movement and withdrawal of the terminals can be prevented.

Furthermore, the terminal retaining piece portion has a pair of opposed side portions, and a lock hole for engagement with the retaining pawl. With this construction, there is achieved an effect that the terminals can be easily fitted into the positioning member, and are prevented from angular movement and withdrawal.

Still further, the lock hole has such a large size that the terminal retaining piece portion is formed into a U-shaped frame-like configuration. With this construction, there is achieved an effect that the terminal retaining piece portion is reduced in rigidity, and therefore can be easily fitted into the positioning member.

Still further, the width of the terminal retaining piece portion between the outer edges of the opposed side portions is smaller than the width of the electrical contact portion between the opposite side edges thereof extending in the direction of the axis of the terminal, so that the stoppers for engagement with the angular movement prevention grooves are formed at the junction between the terminal retaining piece portion and the electrical contact portion. With this construction, there is achieved an effect that the movement of the terminals in the fitting direction is limited, so that the positioning of the terminals can be effected more positively.

Still further, the terminal is the nut-carrying terminal, and has the plurality of guide pawls formed on the peripheral edge of the electrical contact portion, and the terminal includes the nut member angularly movably mounted on the electrical contact portion by the guide pawls. With this construction, there is achieved an effect that the efficiency of the terminal-mounting operation is further enhanced.

What is claimed is:

1. A terminal connecting-fixing construction for fixedly fastening at least two plate-like terminals to a mating connection portion having connection bolts corresponding respectively to the terminals, each of the terminals including a wire connection portion formed integrally with and extending from an electrical contact portion having a screw insertion hole, the terminal connecting-fixing construction comprising:

a terminal retaining piece portions for positioning the terminals, each formed on an edge of the electrical contact portion directed away from the respective wire connection portions; and a positioning member which includes positioning terminals for fitting respectively on the terminal retaining piece portions, and a mounting board fixedly holding the positioning terminals such that the positioning terminals correspond respectively to the connection bolts, wherein the terminals are fixedly fastened, together with the positioning member, to the mating connection portion.

2. The terminal connecting-fixing construction according to claim 1, wherein each of the positioning terminals includes an electric conductor portion for the electrical contact portion of the terminal, a positioning portion for fitting on the terminal retaining piece portion to prevent the angular movement and withdrawal of the terminal, and a fixing portion fixedly mounted on the mounting board, and the electric conductor portion, the positioning portion and the fixing portion are formed integrally with one another, and the electric conductor portion has a screw hole corresponding to the screw insertion hole in the electrical contact portion, and the positioning portion includes a pair of angular movement prevention guide grooves for guiding the terminal retaining piece portion, and a retaining pawl for preventing the terminal retaining piece portion from moving in a withdrawing direction.

3. The terminal connecting-fixing construction according to claim 2, in which the terminal retaining piece portion has a pair of opposed side portions, and a lock hole for engagement with the retaining pawl.

4. The terminal connecting-fixing construction according to claim 3, wherein the lock hole has such a large size that the terminal retaining piece portion is formed into a U-shaped frame-like configuration.

5. The terminal connecting-fixing construction according to claim 3, wherein the retaining pawl has a wedge shape gradually higher toward the positioning member.

6. The terminal connecting-fixing construction according to claim 1, wherein a width of the terminal retaining piece portion between outer edges of the opposed side portions is smaller than a width of the electrical contact portion between opposite side edges thereof extending in a direction of an axis of the terminal, so that stoppers for engagement with the angular movement prevention grooves are formed at the junction between the terminal retaining piece portion and the electrical contact portion.

7. The terminal connecting-fixing construction according to claim 1, wherein the terminal has a plurality of guide pawls formed on a peripheral edge of the electrical contact portion, and a nut member angularly movably mounted on the electrical contact portion by the guide pawls.

8. The terminal connecting-fixing construction according to claim 1, wherein the mounting board of the positioning member is made of a synthetic resin.

* * * * *

UNITED STATES PATENT AND TRADEMARK OFFICE

CERTIFICATE OF CORRECTION

PATENT NO. : 5,997,341
DATED : December 7, 1999
INVENTOR(S) : Keiji Ushiyama et al.

It is certified that error appears in the above-identified patent and that said Letters Patent is hereby corrected as shown below:

Item [30] FOREIGN APPLICATION PRIORITY DATA:

--July 10, 1997 [JP] Japan..... 9-185134--

Signed and Sealed this

Third Day of July, 2001

*Attest:*

Nicholas P. Godici

NICHOLAS P. GODICI
*Acting Director of the United States Patent and Trademark Office*

*Attesting Officer*